US006634125B2

(12) United States Patent
Abramson et al.

(10) Patent No.: US 6,634,125 B2
(45) Date of Patent: Oct. 21, 2003

(54) INFORMATION DISPLAY SYSTEM

(76) Inventors: Brian Abramson, 365 Kennedy Road South, Brampton Ontario (CA), L6W 3H3; Steven Ferguson, 484 Avenue Road, Suite #1009 Toronto Ontario (CA), M4V 2J4

( * ) Notice: Subject to any disclaimer, the term of this patent is extended or adjusted under 35 U.S.C. 154(b) by 142 days.

(21) Appl. No.: 09/789,807

(22) Filed: Feb. 22, 2001

(65) Prior Publication Data

US 2002/0112388 A1 Aug. 22, 2002

(51) Int. Cl.[7] ..... G09F 3/18
(52) U.S. Cl. ..... 40/642.02
(58) Field of Search ..... 40/394–397, 642.02; 211/119.003, 86.01

(56) References Cited

U.S. PATENT DOCUMENTS 4,821,437 A 4/1989 Abramson et al.
4,829,691 A 5/1989 Manjos et al.
5,215,364 A * 6/1993 Moore ..... 312/323
5,408,775 A 4/1995 Abramson et al.
5,799,427 A 9/1998 Abramson et al.
5,992,665 A 11/1999 Deeter

* cited by examiner

*Primary Examiner*—Cassandra H. Davis
(74) *Attorney, Agent, or Firm*—Marks & Clerk

(57) ABSTRACT

An information display system in retail stores is used to display, hold and protect product information display cards, and comprises a shelf contacting panel, a front presentation face, a pair of stiffening ribs, two side panels and at least one display pocket, all formed as an integral structure to which at least one display pocket is hingedly attached. The display pocket is openable so that an information display card may be inserted. Prospective customers may read the information contained on the front and back of the information display cards by simply turning the display pocket on its hinge. Retail store personnel may also easily replace or rearrange the information display cards within the information display system. When the information display system comprises at least two display pockets, they are arranged in such a manner that one display pocket overlies a substantial portion of another display pocket. Thus, more information can be displayed in a small area.

24 Claims, 18 Drawing Sheets

INFORMATION DISPLAY SYSTEM

FIELD OF THE INVENTION

This invention relates to display devices, and particularly relates to information display devices which are used to display, hold and protect product information display cards at retail stores. In particular, the present invention is directed towards information display systems in which the information display cards within the information display systems may be easily replaced or rearranged by retail store personnel. Furthermore, the information display system of the present invention is such that it may be easily manipulated by the prospective customers so as to obtain ready visual access information on a merchandise item.

BACKGROUND OF THE INVENTION

Display devices are commonly used by retailers to display product information. Display devices are most suitable for products in which a substantial description of their features and specifications needs to be delivered to customers. Such products may include various electronic devices, automobile accessories, machinery and tools. At the same time, the use of display devices also permits an attractive display of product advertisements.

The field of display devices is indeed a crowded art and encompasses a wide variety of differing embodiments. In general, a display device comprises at least one display card and a transparent panel which overlies at least one display card. The display card provides all of the requisite information about the particular merchandise product. The product information shown on the display card may be in the form of written descriptions, photos, graphic arts or any combination thereof. Typically, a display device is mounted on the front edge region of a shelving unit such that customers have ready visual access to the product information on the display card.

Most display devices available in the market to date are manufactured from a relatively rigid plastic or synthetic resinous material, using an extrusion process. This process requires the expensive preparation of a mould and the cutting of extruded sheets of plastic or synthetic resinous material for the display devices. The entire manufacturing process is time consuming and expensive. In fact, if the retailer demands a large number of display devices, he needs to place orders far in advance. Furthermore, since the unit cost of manufacturing such display devices is so high, purchasing a display device for each kind of product in the retailer's inventory may become very expensive.

The present inventors herein have provided an information display system which is simple and economical to manufacture. The information display system of the present invention is vacuum formed from plastics material. This process of manufacturing is much faster and cost-effective when compared to the extrusion process described above. Here, the expensive construction of an extrusion mould for the information display system is not required, as the base portion of the information display system of the present invention is typically vacuum formed over a relatively inexpensive vacuum forming mould.

Furthermore, the structural features of the information display system of the present invention make it a much more versatile display system than those provided in the prior art. The information display system of the present invention is an integral structure having at least one display pocket which is hingedly attached. Each of the at least one display pocket is openable in at least one of its ends such that at least one information display card may be inserted into the at least one display pocket. The at least one display pocket functions to protect the at least one information display card, especially its edges from damage. Prospective customers may read the information contained on the front and back of the information display cards by simply turning the display pocket on its hinge. Retail store personnel may also easily replace or rearrange the information display card within the information display system of the present invention.

When the information display system comprises at least a first display pocket and at least a second display pocket, however, the at least two display pockets are arranged in such a manner that the first display pocket overlies a substantial portion of the second display pocket. Placement of the display pockets in such an overlapping manner greatly increases the amount of information that can be displayed in a small area.

DESCRIPTION OF THE PRIOR ART

Several typical prior art display devices are now described. They include ABRAMSON and BAKE U.S. Pat. No. 4,821,437, issued Apr. 18, 1989, which reveals a merchandise display system. The system includes support means for holding information display means in the form of items or modules having information on the front and back sides thereof. The support means provided by the invention is an extrusion mountable on a wall or other surface in a position to allow viewing of the information display means or product information modules. The support means comprises flexible attachment means such that manipulation of the information display means is permitted. The flexible attachment means is generally a plurality of flexible strips extending from the support means and having free ends thereof. The free ends of the attachment means are adapted to hold the information display means.

In U.S. Pat. No. 4,829,691 issued May 16, 1989 to MANJOS and TRESTYN, the inventors have provided a card display holder and protector which comprises first and second transparent panels connected to one another by a common hinge line. The display holder receives the card to be displayed into the recessed portion of the first panel. The second panel has a projecting surface so as to engage the first panel and to maintain the display holder in a closed position.

In another U.S. Pat. No. 5,408,775 issued Apr. 25, 1995, the inventors ABRAMSON and STEWART teach a merchandise information system which comprises a support having a rigid base, and a plurality of spaced flexible webs, where the flexible webs depend from the rigid base. The display items are attached to the lower end of the webs, and are arranged in a side by side fashion. Typically, the display items are clear plastic envelopes which are adapted to receive display cards or the like. The display items may be viewed through either the front or rear surface of the envelope as the envelopes may be rotated about the respective flexible webs.

U.S. Pat. No. 5,799,427 issued Sep. 1, 1998 to ABRAMSON and STEWART teaches an overlapping merchandise information display module. The system comprises a rigid base, and a plurality of spaced flexible webs which depend from the lower edge of the rigid base. A series of overlapping display items are attached to the lower ends of each of the webs respectively to display one side of the item. The display items may be rotated about the flexible webs so as to display the other side of the item.

In a co-pending U.S. patent application Ser. No. 09/608,948, filed on Jun. 30, 2000, the present inventors ABRAM- SON and FERGUSON herein have provided a protective display system which includes at least a first pair of transparent panels wherein each panel has a front face, a back face, and at least one straight peripheral edge and a flexible living hinge. The at least first pair of panels is an envelope which is adapted to receive at least one display card. The protective display system is an unitary structure and the flexible living hinge has greater flexibility than each of the at least one pair of panels.

SUMMARY OF THE INVENTION

In accordance with one aspect of the present invention, there is provided an information display system which is adapted to be affixed to the substantially planar top support surface of a shelf having a downwardly depending front edge in the front edge region thereof. The information display system of the present invention comprises a base portion which includes a shelf contacting panel, a front presentation face, a pair of stiffening ribs, and two side panels, together with at least one display pocket. The information display system is constructed in such a manner that the base portion is an integral structure.

The front presentation face is in a plane which intersects the plane of the shelf contacting panel. Furthermore, there is at least one display pocket which is hingedly attached to the front presentation face.

The front presentation face has first and second ends where each of the first and second ends has one stiffening rib and one side panel which are contiguous one with the other. The stiffening rib and the respective side panel occupy the same plane which is perpendicular to the plane of the front presentation face and the plane of the shelf contacting panel.

Each of the stiffening ribs extends outwardly beyond the front presentation face and each of the stiffening ribs has an edge which coincides with the respective first and second ends of the front presentation face in the edge regions thereof.

Each of the side panels has one side edge which contacts one of the substantially planar top support surface of the shelf in the front edge region thereof, or the surface of the front shelf edge, when the information display system is in use.

The at least one display pocket has top and bottom edges and first and second side ends. Furthermore, the at least one display pocket has top and bottom panels and is such that the top panel overlies a substantial portion of the bottom panel.

The bottom edge of the top panel and the bottom edge of the bottom panel are sealed one to the other. However, the at least one display pocket is openable in at least one of the top and first and second side ends such that at least one display card may be inserted between the top and bottom panels of the at least one display pocket.

The top panel of the at least one display pocket has at least a portion in the region of the top edge which forms a hinge so as to hingedly attach the at least one display pocket to the front presentation face. When the at least one display pocket is hingedly attached to the front presentation face, the first and second side ends of the at least one display pocket lie adjacent to the respective stiffening ribs.

Typically, but not necessarily, the information display system is formed from plastics material. The plastics material of the at least one display pocket is translucent such that each of the faces of the at least one display card which is contiguous with the top and bottom panels of the at least one display pocket is visible through the top and bottom panels of the at least one display pocket.

In a particular embodiment of the present invention, a portion of the front presentation face comprises a plurality of steps, where at least one of the steps is adapted to have at least one display pocket. The at least one display pocket is hingedly attached to the front presentation face.

Typically, but not necessarily, the hinge portion of the top panel of the at least one display pocket has at least one tang projecting therefrom.

Thus, in order to permit the at least one display pocket to be hingedly attached to the front presentation face, the front presentation face has at least one opening through which the at least one tang projecting from the hinge portion of the top panel of the at least one display pocket may be inserted.

Alternatively, but not necessarily, the hinge portion of the top panel of the at least one display pocket may have at least one button formed thereon.

In such a particular embodiment, the front presentation face has at least one opening through which the at least one button which is formed on the hinge portion of the top panel of the at least one display pocket may be inserted so as to permit the at least one display pocket to be hingedly attached to the front presentation face.

In keeping with the present invention, the at least one display pocket is hingedly attached to the front presentation face by fastening means which is chosen from the group of fastening means consisting of:

(a) inserting at least one tang which projects from the hinge portion of the top panel of the at least one display pocket through the at least one opening situated in the front presentation face;

(b) inserting at least one button which is formed on the hinge portion of the top panel of the at least one display pocket through the at least one opening situated in the front presentation face;

(c) gluing the hinge portion of the top panel of the at least one display pocket to the front presentation face; and (d) welding the hinge portion of the top panel of the at least one display pocket to the front presentation face.

When the first display pocket is hingedly rotated upward at least 90 degrees from the plane of the front presentation face, the back panel of the first display pocket is visible.

In another embodiment of the present invention, the information display system comprises at least a first display pocket and at least a second display pocket. Typically, the at least two display pockets are arranged in a stepped manner such that the first display pocket overlies a substantial portion of the second display pocket when the information display system is in a static position.

When the first display pocket is hingedly rotated upward at least 90 degrees from the plane of the front presentation face, the back panel of the first display pocket and the top panel of the second display pocket are visible.

Typically, but not necessarily, the base portion of the information display system which is described above may further comprise a supporting panel. The supporting panel extends upwardly from the shelf contacting panel, and the supporting panel and the shelf contacting panel are contiguous one with the other.

Furthermore, the supporting panel is in a plane which intersects the plane of the shelf contacting panel. Still further, the plane of the supporting panel intersects the plane of the front presentation face and each of the planes occupied by each of the stiffening ribs and the respective side panels. Moreover, the supporting panel has first and second side edges, where each of the first and second side edges coincides with one of the side edges of each of the side panels.

Generally, the shelf contacting panel is adapted to be affixed to the substantially planar top support surface of a shelf having a downwardly depending front edge region thereof by attachment means which may be chosen from the group of attachment means consisting of bolts, rivets, studs, pins, and staples.

In a particular embodiment of the present invention, the shelf contacting panel and the front presentation face of the base portion are in two halves. In such an embodiment, a portion of one half of the shelf contacting panel overlies a portion of the other half of the shelf contacting panel, and a portion of one half of the front presentation face overlies a portion of the other half of the front presentation face. The two halves of the shelf contacting panel are joined one over the other so as to form an integral structure.

In another embodiment of the present invention, the shelf contacting panel, the supporting panel and the front presentation face of the base portion are in two halves. In such an embodiment, a portion of one half of the shelf contacting panel overlies a portion of the other half of the shelf contacting panel, a portion of one half of the supporting panel overlies a portion of the other half of the supporting panel, and a portion of one half of the front presentation face overlies a portion of the other half of the front presentation face. The two halves of the shelf contacting panel are joined one over the other so as to form an integral structure.

These and other objects of the present invention are discussed in greater detail hereafter, in association with the accompanying drawings.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

As noted above, a feature of the present invention is essentially to provide an information display system which functions to display, hold and protect product information display cards at retail stores. The information display system is constructed in such a manner that the information display cards within the information display system may be easily replaced or rearranged by retail store personnel. Furthermore, the information display system of the present invention is such that it may be easily manipulated by prospective customers so as to obtain ready visual access information on a merchandise item.

Figure 1:
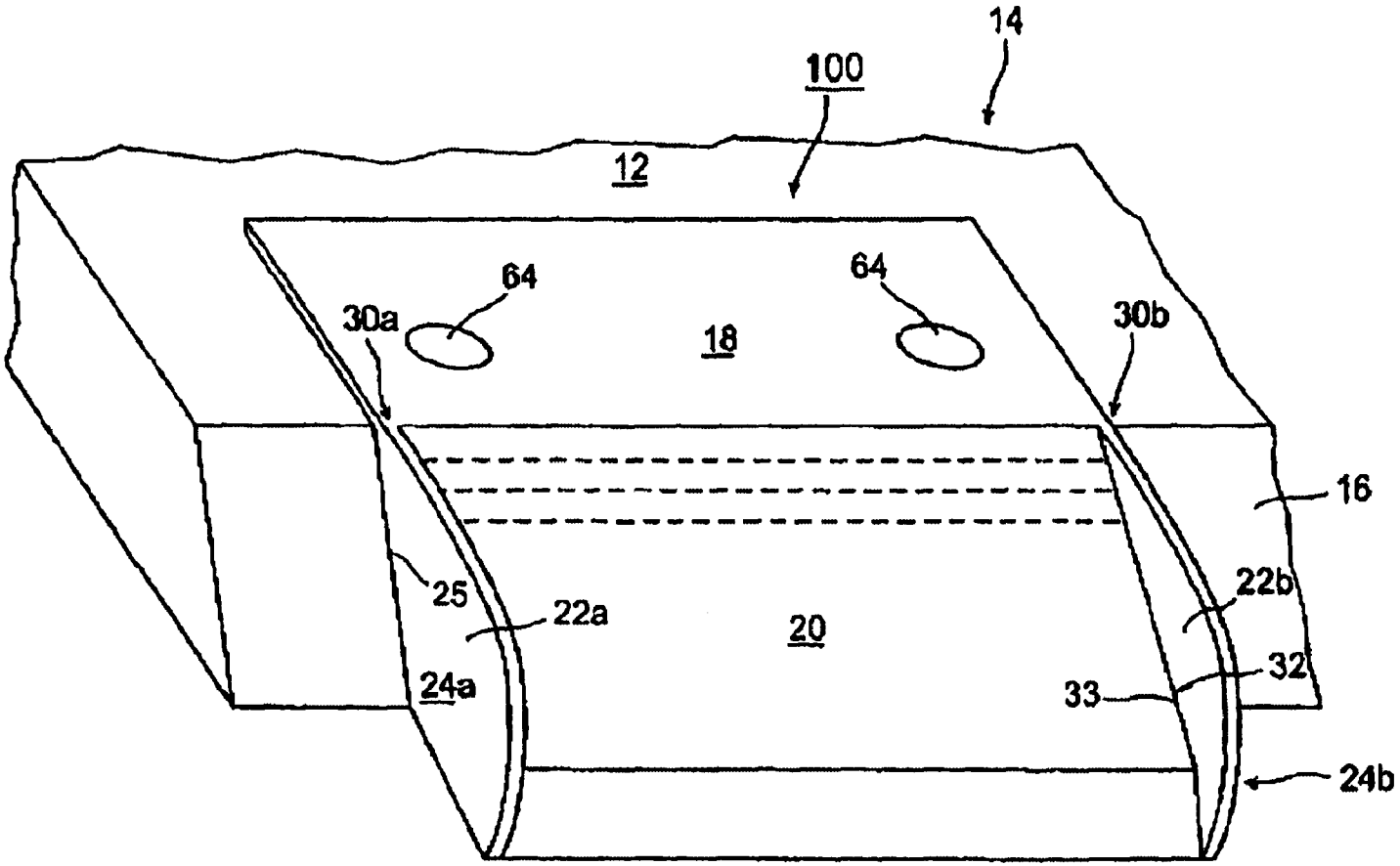
FIG. 1 is a perspective view of a first embodiment of the information display system in keeping with the present invention, when affixed to the substantially planar top support surface of a shelf having a downwardly depending front edge in the front edge region thereof.
Figure 2:
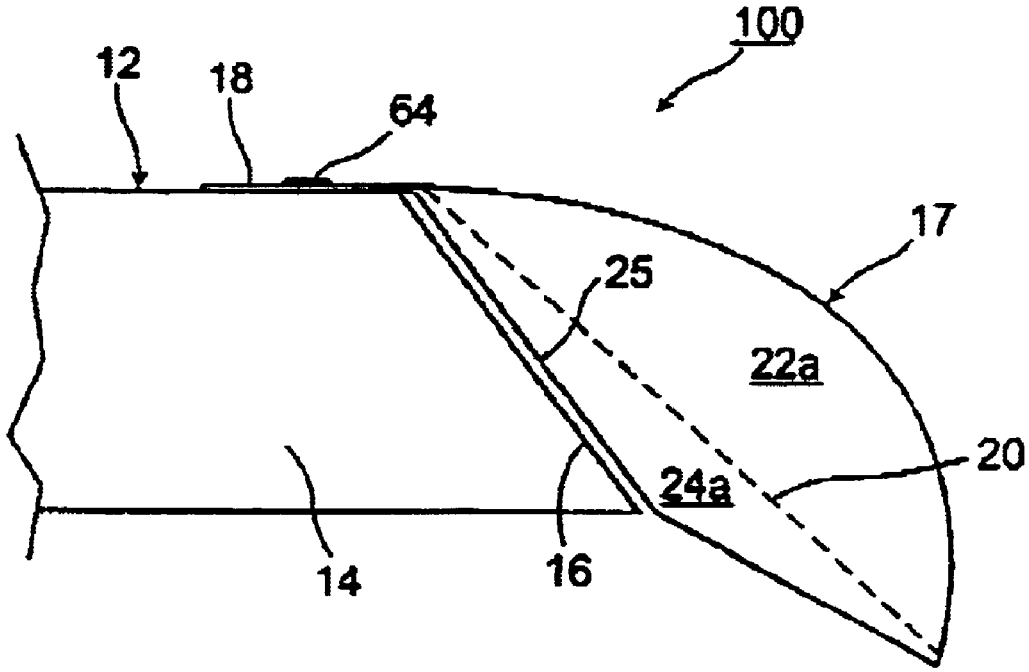
FIG. 2 is a side view of a first embodiment of the information display system in keeping with the present invention, when affixed to the substantially planar top support surface of a shelf having a downwardly depending front edge in the front edge region thereof.

Turning first to FIGS. 1 and 2, a perspective view and a side view, respectively, of an information display system 100 are shown. The information display system 100 is adapted to be affixed to the substantially planar top support surface 12 of a shelf 14 having a downwardly depending front edge 16 in the front edge region thereof.

As can be seen particularly in FIG. 1, the information display system 100 comprises a base portion 17 which includes a shelf contacting panel 18, a front presentation face 20, a pair of stiffening ribs 22*a* and 22*b*, and two side panels 24*a* and 24*b*. The information display system 100 is constructed in such a manner that the base portion 17 is an integral structure.

The front presentation face 20 is in a plane which intersects the plane of the shelf contacting panel 18. At least one display pocket 26 (as will be shown in FIG. 8) is hingedly attached to the front presentation face 20 in the region designated by dotted lines in FIG. 1.

The front presentation face 20 has first and second ends, 30*a* and 30*b* respectively. The first end 30*a* of the front presentation face 20 has stiffening rib 22*a* and side panel 24*a* while the second end 30*b* of the front presentation face 20 has stiffening rib 22*b* and side panel 24*b*. The stiffening rib 22 and the respective side panel 24 at each of the respective first and second ends 30*a* and 30*b* of the front presentation face 20 occupy the same plane, which is perpendicular to the plane of the front presentation face 20 and the plane of the shelf contacting panel 18.

Each of the stiffening ribs 22 extends outwardly beyond the front presentation face 20. Furthermore, each of the stiffening ribs 22 has an edge 32 which coincides with the respective first and second ends 30*a* and 30*b* of the front presentation face 20 in the edge regions 33 thereof.

When the information display system 100 is in use, each of the side panels 24 has one side edge 25 which contacts the surface of the front shelf edge 16 of the shelf 14.

Figure 3:
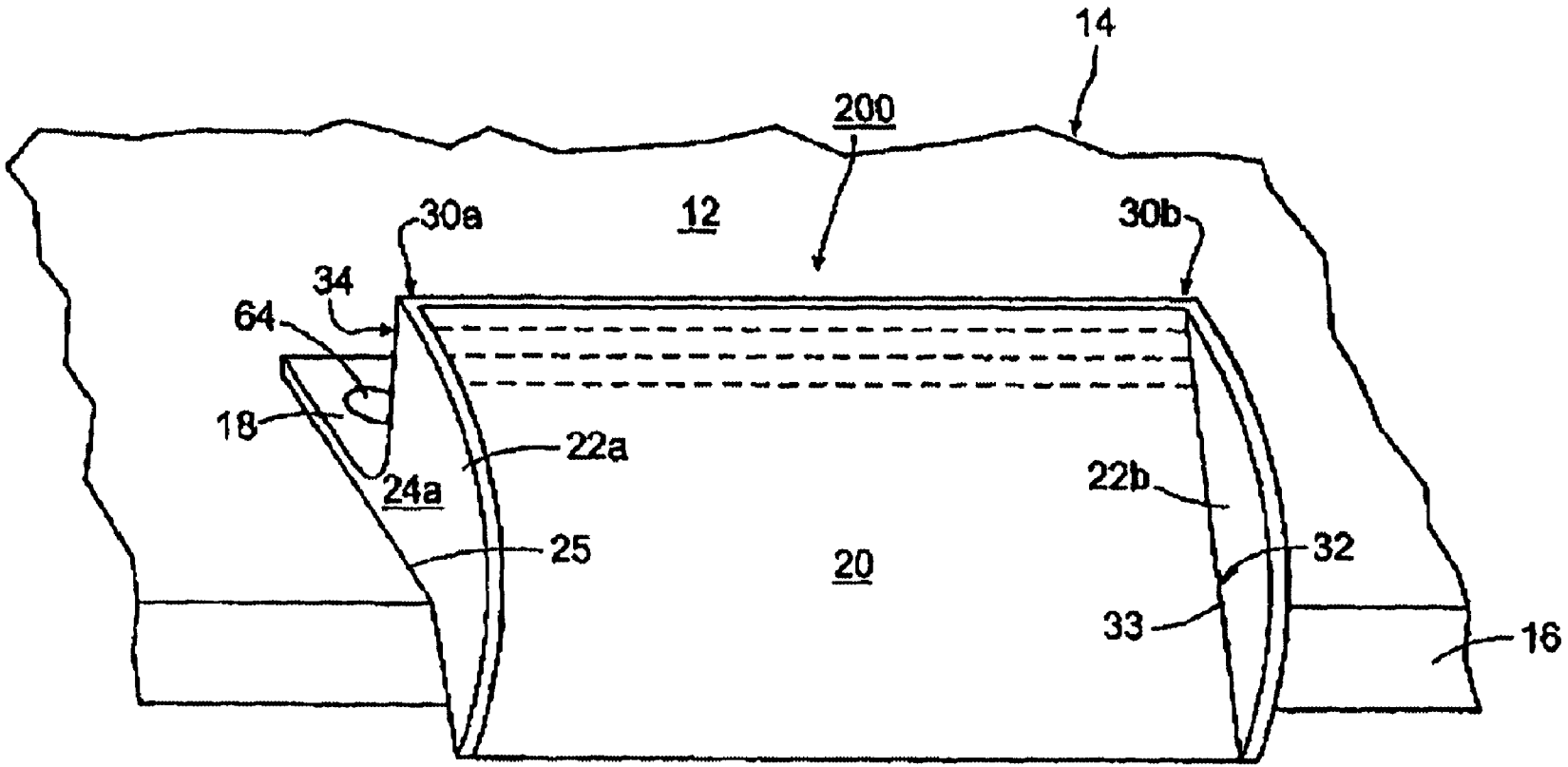
FIG. 3 is a perspective view of a second embodiment of the information display system in keeping with the present invention, when affixed to the substantially planar top support surface of a shelf having a downwardly depending front edge in the front edge region thereof.
Figure 4:
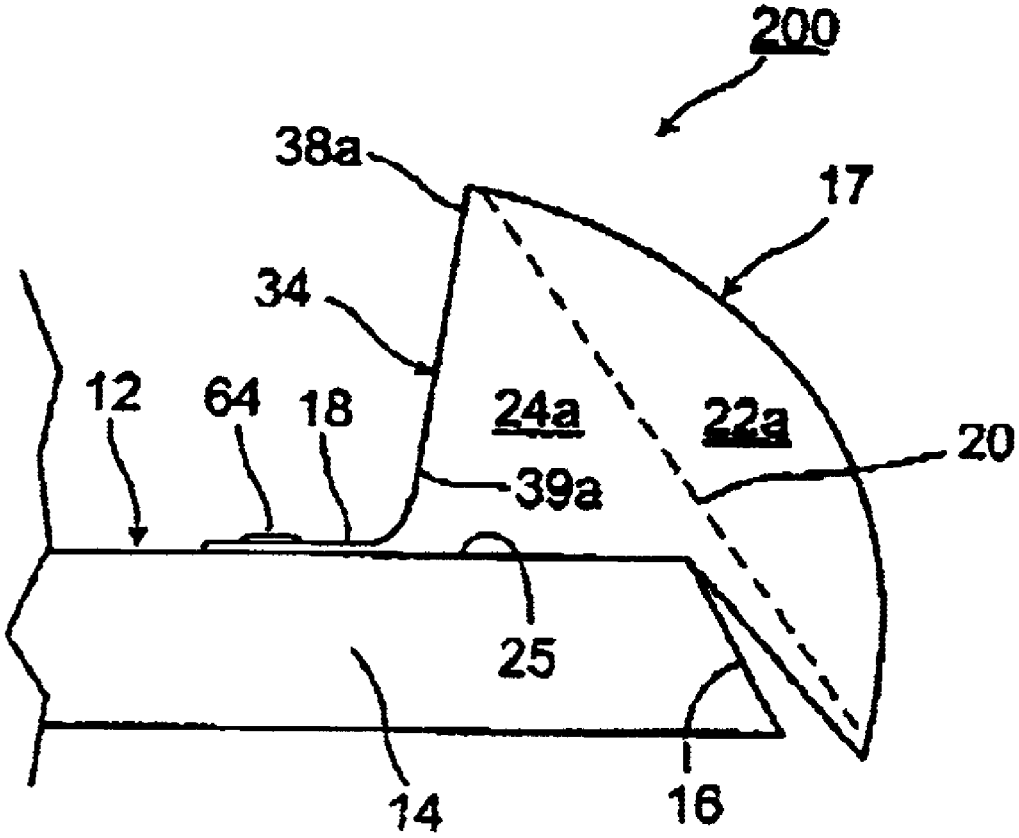
FIG. 4 is a side view of a second embodiment of the information display system in keeping with the present invention, when affixed to the substantially planar top support surface of a shelf having a downwardly depending front edge in the front edge region thereof.

A second embodiment of the present invention is shown in FIGS. 3 and 4. Here, the base portion 17 of the information display system 200 further comprises a supporting panel 34. The supporting panel 34 extends upwardly from the shelf contacting panel 18, and is such that the supporting panel 34 and the shelf contacting panel 18 are contiguous one with the other.

Furthermore, the supporting panel 34 has a plane which intersects the plane of the shelf contacting panel 18. Still further, the plane of the supporting panel 34 intersects the plane of the front presentation face 20 and each of the planes occupied by each of the stiffening ribs 22 and the respective side panels 24.

As particularly suggested by FIG. 4, the supporting panel 34 has first and second side edges 38*a* and 38*b* respectively. Each of the respective first and second side edges 38*a* and 38*b* coincides with the respective side edges 39*a* and 39*b* of each of the respective side panels 24*a* and 24*b*.

When the information display system 200 is in use, each of the side panels 24 has one side edge 25 which contacts the substantially planar top support surface 12 of the shelf 14 in the front edge region 16 thereof.

Figure 5:
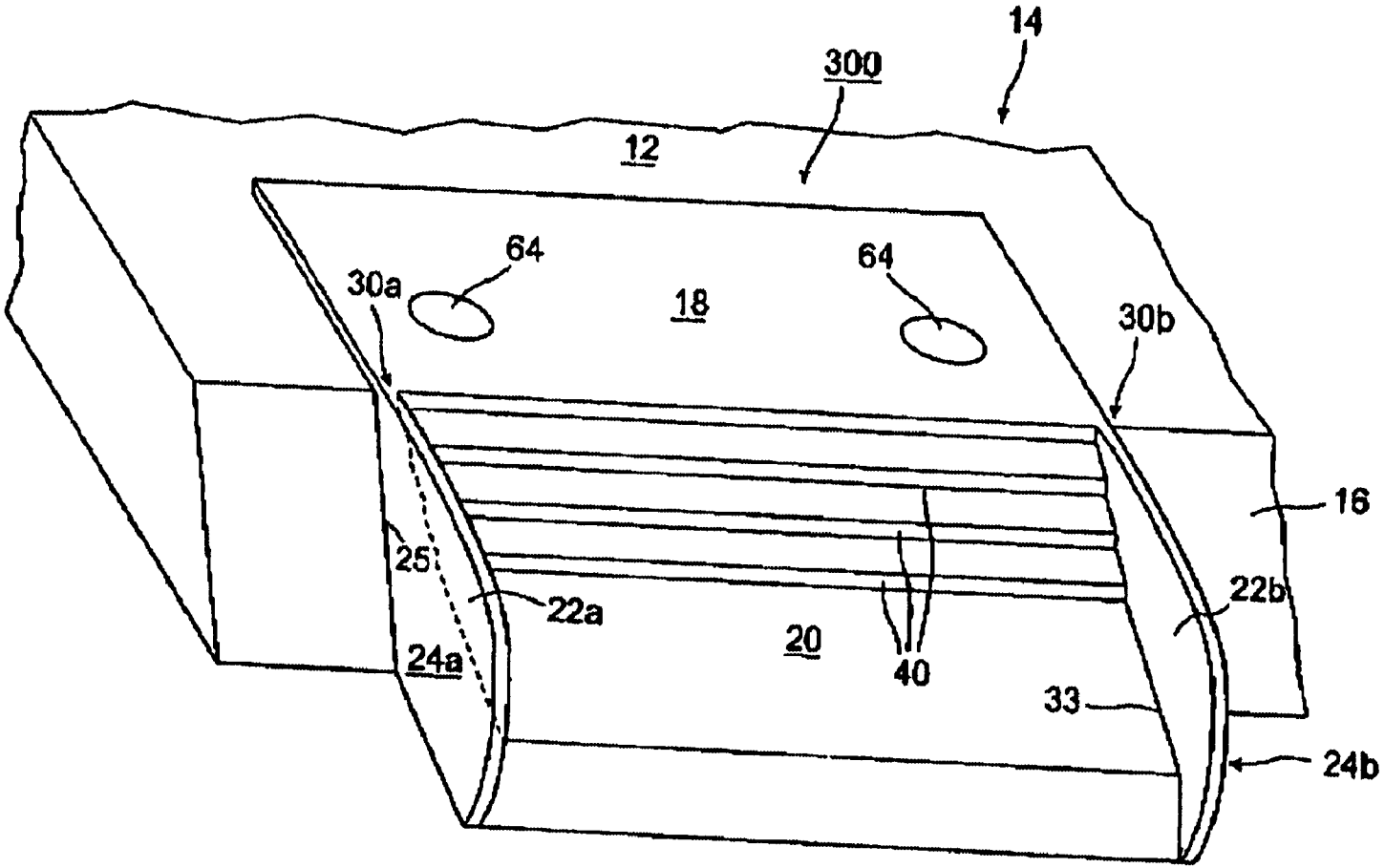
FIG. 5 is a perspective view of a third embodiment of the information display system in keeping with the present invention, when affixed to the substantially planar top support surface of a shelf having a downwardly depending front edge in the front edge region thereof.
Figure 6:
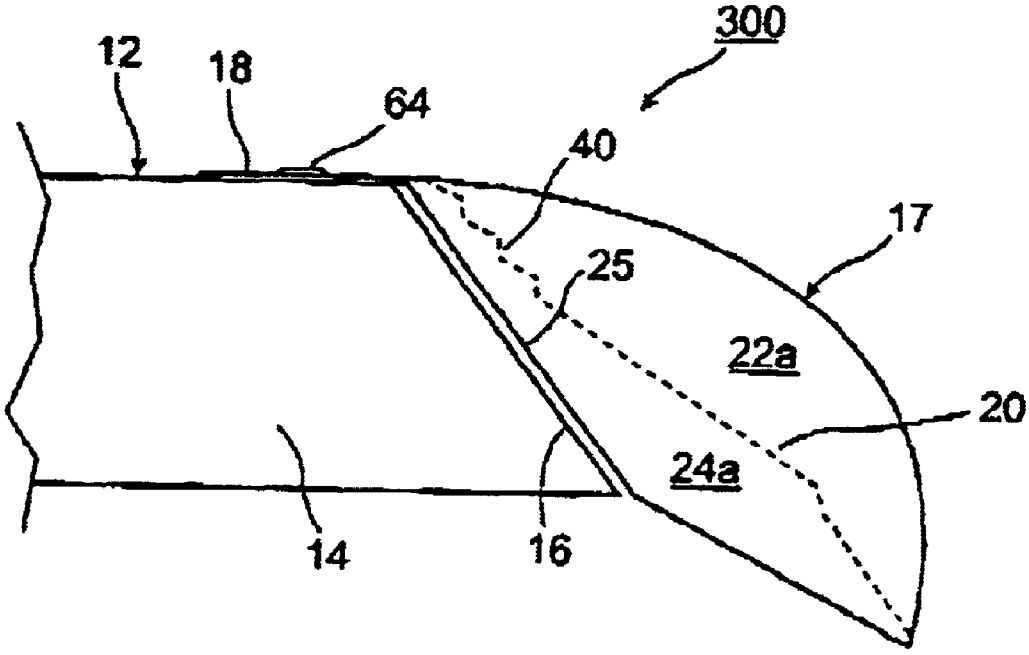
FIG. 6 is a side view of a third embodiment of the information display system in keeping with the present invention, when affixed to the substantially planar top support surface of a shelf having a downwardly depending front edge in the front edge region thereof.

Typically, but not necessarily, a portion of the front presentation face 20 may further comprise a plurality of steps 40, as shown in FIGS. 5 and 6. At least one of the steps 40 of the information display system 300 is adapted to have at least one display pocket 26 (as will be shown in FIG. 8) where the at least one display pocket 26 is hingedly attached. The method of fastening the at least one display pocket 26 to the at least one step 40 of the front presentation face 20 will be discussed in detail hereafter.

The plurality of steps 40 are generally arranged in a parallel manner and are such that the plurality of steps 40 project outwardly in a direction away from the front presentation face 20. Each of the steps 40 descends in height from the top edge of the front presentation face 20 toward the central portion of the front presentation face 20. In use, the different height steps 40 permit partial overlapping of the display pockets 26, as will be shown hereafter.

Figure 7:
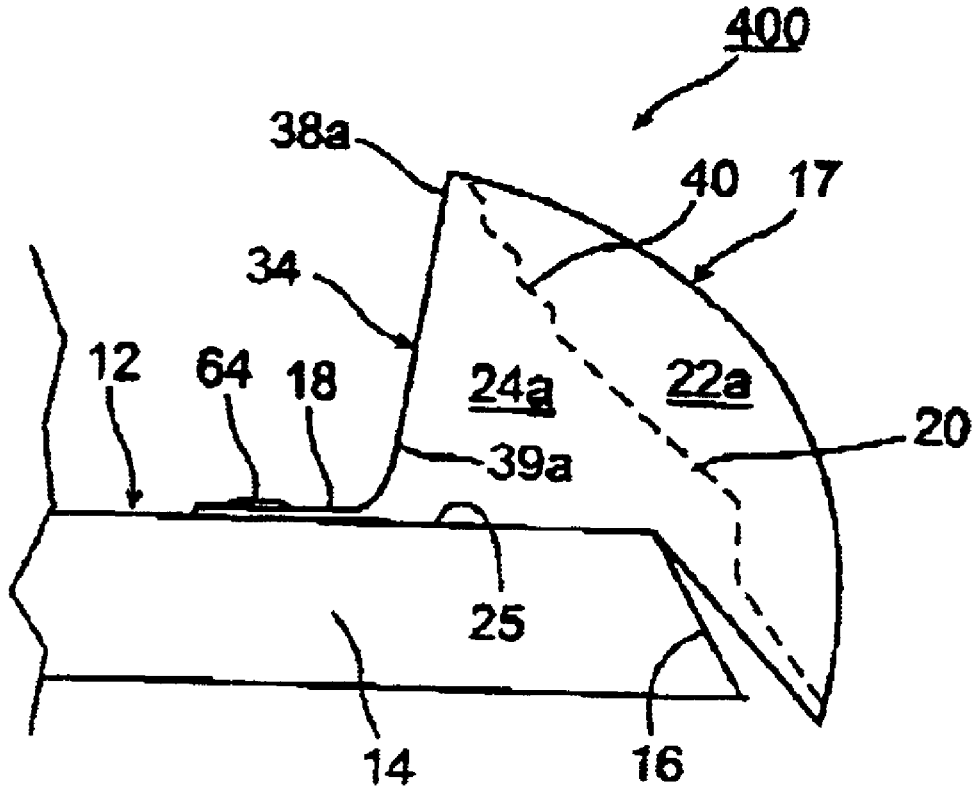
FIG. 7 is a side view of a fourth embodiment of the information display system in keeping with the present invention, when affixed to the substantially planar top support surface of a shelf having a downwardly depending front edge in the front edge region thereof.

In another embodiment of the present invention shown in FIG. 7, the information display system 400 comprises a supporting panel 34 and a plurality of steps 40 to which the at least one display pocket 26 may be hingedly attached.

Figure 8:
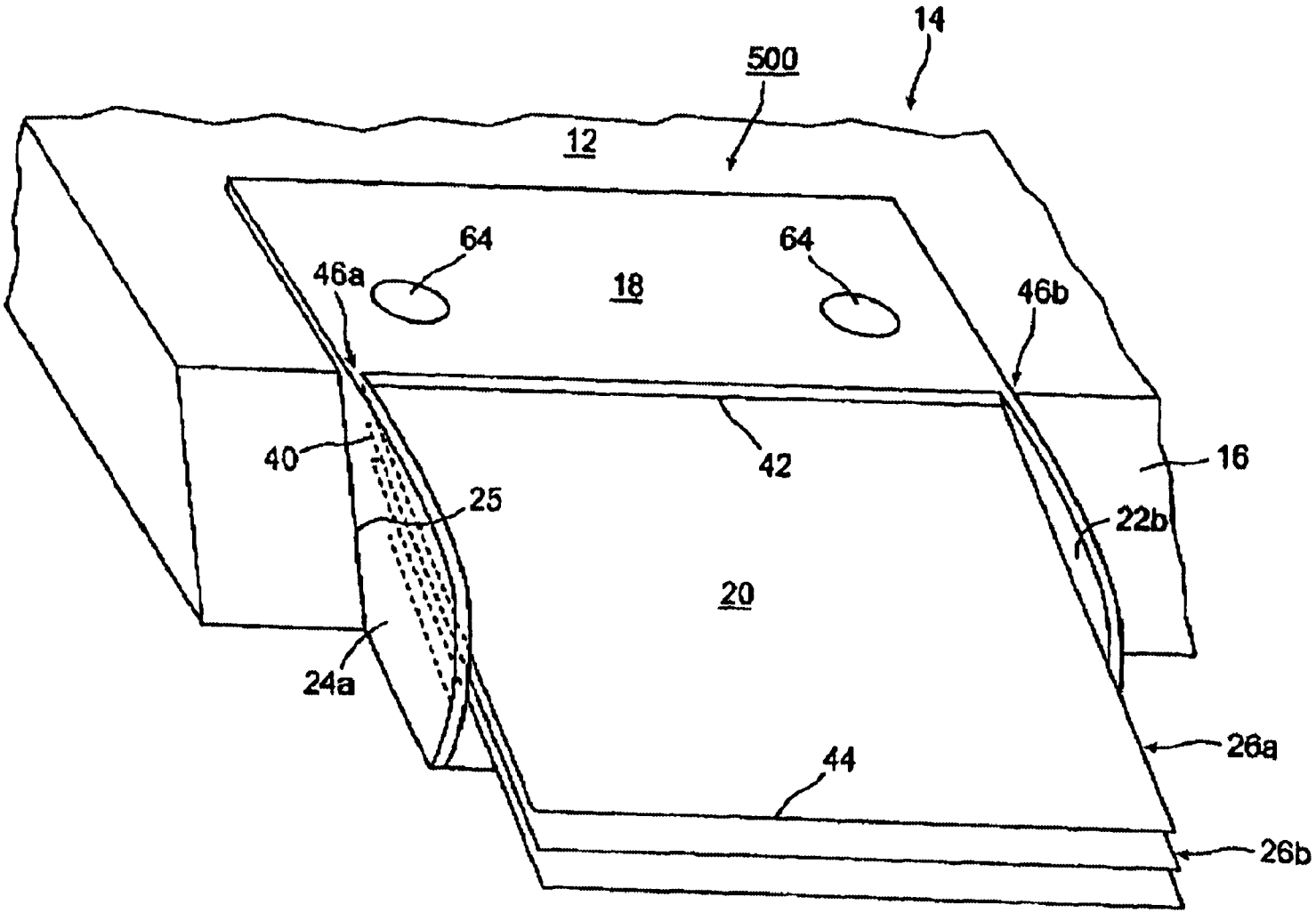
FIG. 8 is a perspective view of a fifth embodiment of the information display system in keeping with the present invention, when affixed to the substantially planar top support surface of a shelf having a downwardly depending front edge in the front edge region thereof.
Figure 9:
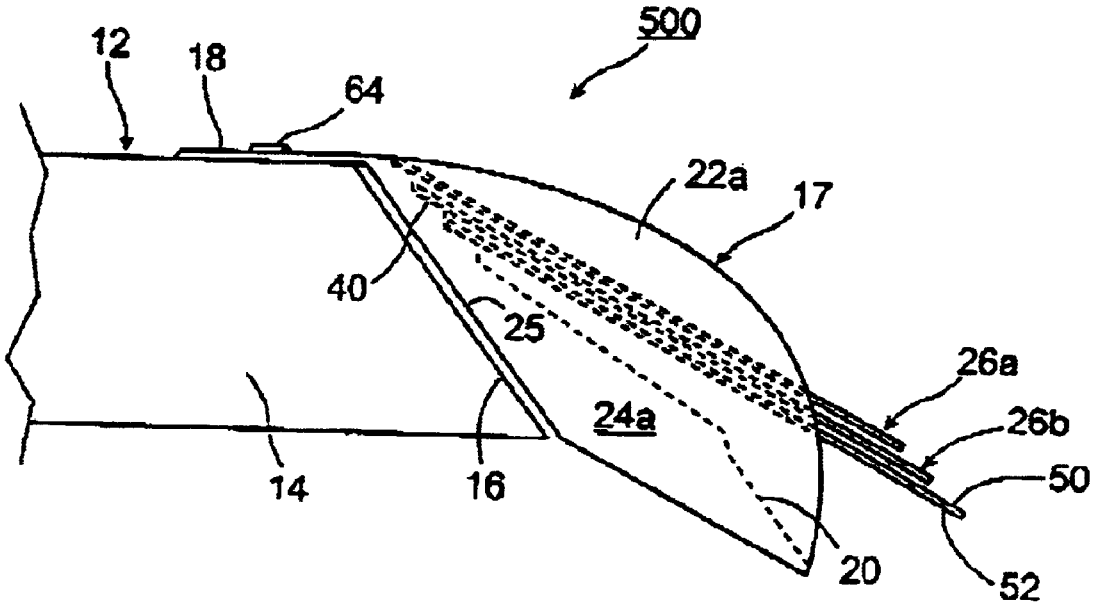
FIG. 9 is a side view of a fifth embodiment of the information display system in keeping with the present invention, when affixed to the substantially planar top support surface of a shelf having a downwardly depending front edge in the front edge region thereof.
Figure 10:
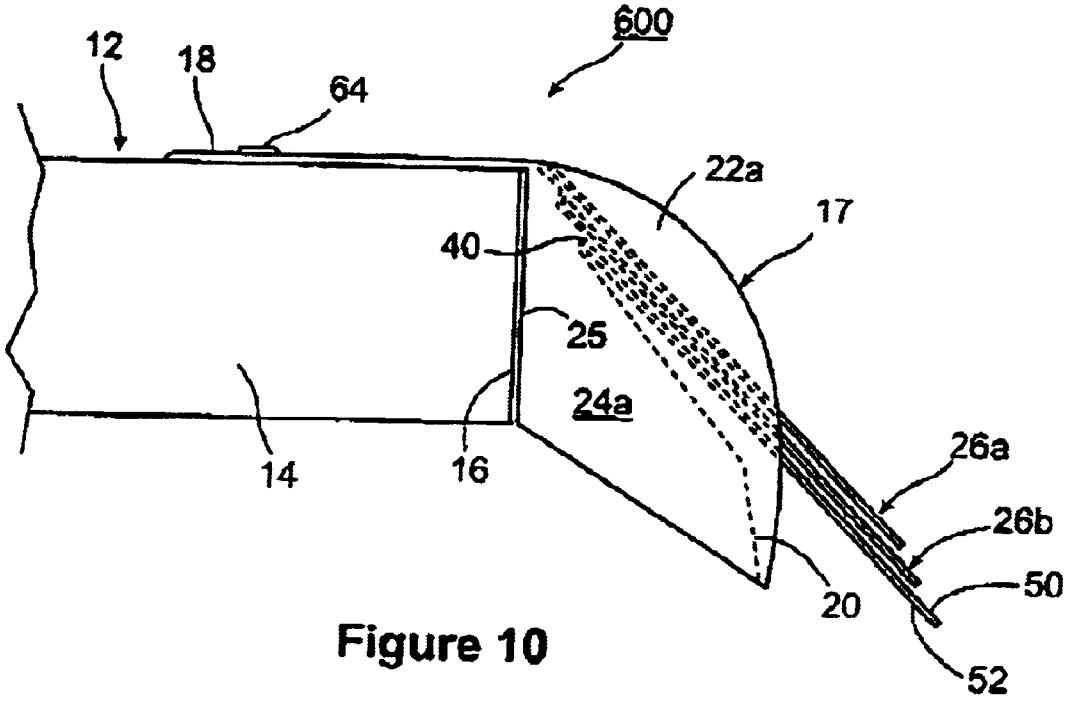
FIG. 10 is a side view of a sixth embodiment of the information display system in keeping with the present invention, when affixed to the substantially planar top support surface of a shelf having a downwardly depending front edge in the front edge region thereof.
Figure 11:
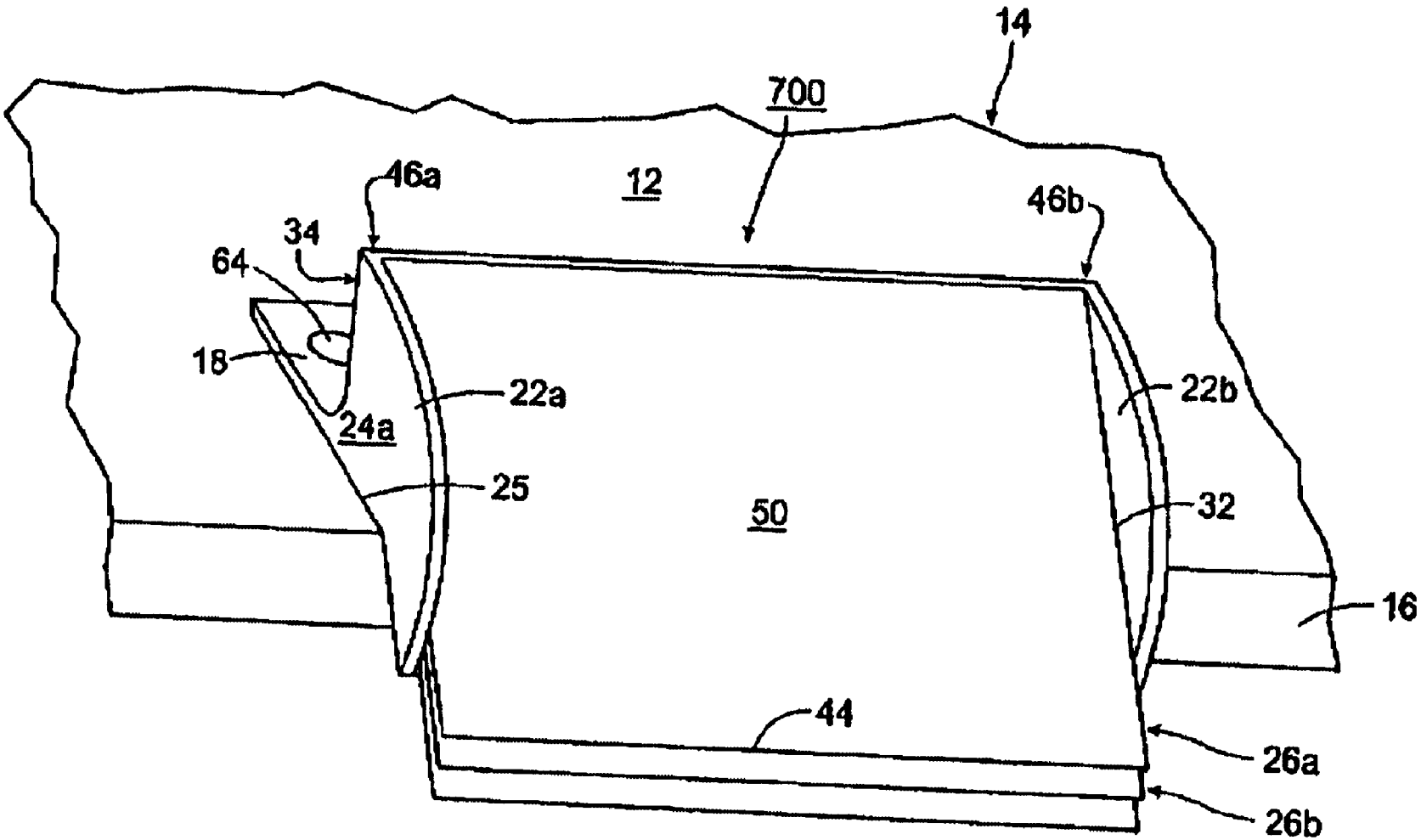
FIG. 11 is a perspective view of a seventh embodiment of the information display system in keeping with the present invention, when affixed to the substantially planar top support surface of a shelf having a downwardly depending front edge in the front edge region thereof.
Figure 12:
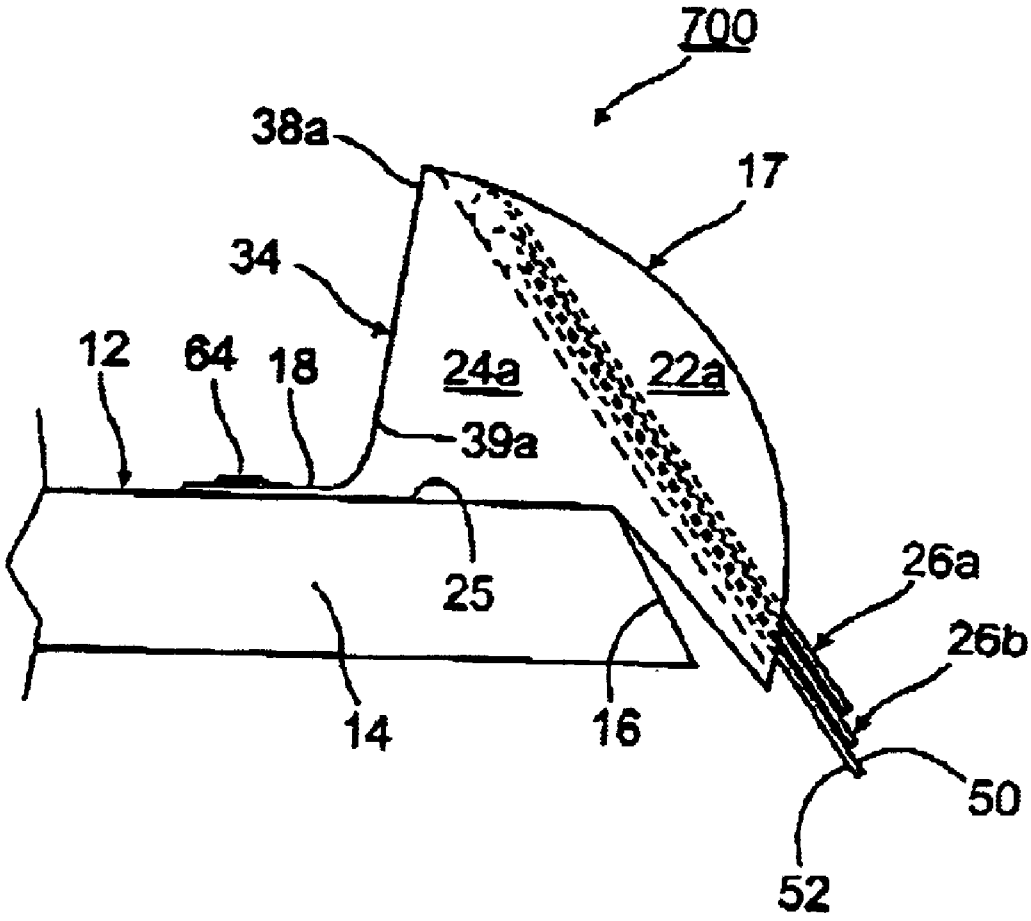
FIG. 12 is a side view of a seventh embodiment of the information display system in keeping with the present invention, when affixed to the substantially planar top support surface of a shelf having a downwardly depending front edge in the front edge region thereof.

Referring now to FIGS. 8 through 12, each of the information display systems 500, 600 and 700 comprises a shelf contacting panel 18, a front presentation face 20, a pair of stiffening ribs 22*a* and 22*b*, two side panels 24*a* and 24*b* and at least one display pocket 26. The information display systems 500 and 700 have the same structural configurations as information display systems 300 and 200 respectively which were described above with the exception that each of the information display systems 500 and 700 has at least one display pocket 26 hingedly attached to the front presentation face 20. When the information display systems 500 and 600 are in use, each of the information display systems 500 and 600 has one side edge 25 which contacts the surface of the front shelf edge 16 of the shelf 14, as seen in FIGS. 8 through 10. In another embodiment of the present invention, the information display system 700 has one side edge 25 which contacts the substantially planar top support surface 12 of the shelf 14 in the front edge region thereof when the information display system 700 is in use (FIGS. 11 and 12). It is important to note that both information display systems 500 and 700 are adapted to be affixed to any shelf 14 having a downwardly depending front shelf edge 16. However, the information display system 600 is only adapted to be affixed to shelves 14 having a vertically straight downwardly depending front shelf edge 16.

Figure 13:
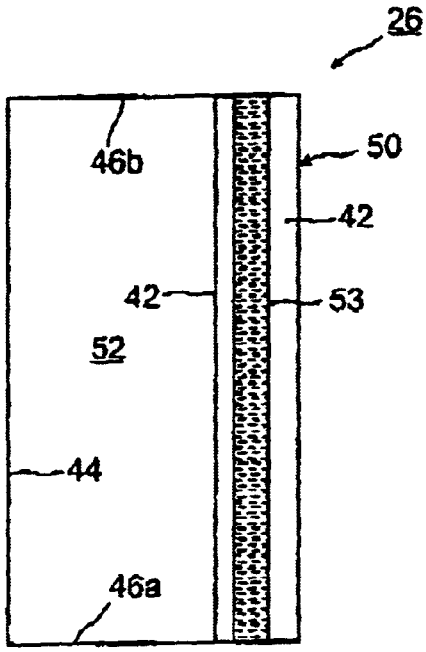
FIG. 13 is a plan view of the inner surface of the display pocket of the information display system in keeping with the present invention.
Figure 14:
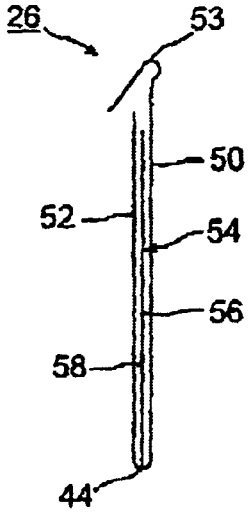
FIG. 14 is a side view of the display pocket of the information display system in keeping with the present invention.

In accordance with the present invention, the at least one display pocket 26 has top and bottom edges 42 and 44 respectively and first and second side ends, which are designated by reference numerals 46*a* and 46*b* respectively (FIG. 13). Furthermore, the at least one display pocket 26 has top and bottom panels 50 and 52 respectively, as can be seen particularly in FIG. 14. The top panel 50 overlies a substantial portion of the bottom panel 52 of the at least one display pocket 26.

As particularly suggested by FIG. 13, the top panel 50 of the at least one display pocket 26 has at least a portion in the region of the top edge 42 which forms a hinge portion 53 so as to hingedly attach the at least one display pocket 26 to the front presentation face 20.

The bottom edge 44 of the top panel 50 and the bottom edge 44 of the bottom panel 52 are sealed one to the other. The at least one display pocket 26 is openable in at least one of the top and first and second side ends, designated by reference numerals 42, 46*a* and 46*b* respectively, such that at least one display card 54 may be inserted between the top and bottom panels 50 and 52 respectively of the at least one display pocket 26. With this construction, the at least one display pocket 26 protects the at least one display card 54, especially the edges of the at least one display card 54 from damage. Furthermore, the at least one display card 54 can be readily exchanged by retail store personnel.

Generally, the front and back faces 56 and 58 respectively of the at least one display card 54 contained the requisite information about a particular piece of merchandise. Thus, the prospective customer may make his or her product selection by simply reading the information contained on the at least one display card 54.

It is noted that the information display systems described herein are all formed from plastics material. The plastics material of the at least one display pocket 26 is translucent such that each of the faces of the at least one display card 54 which is contiguous with the top and bottom panels 50 and 52 respectively of the at least one display pocket 26 is visible through the top and bottom panels 50 and 52 respectively of the at least one display pocket 26.

Figure 15:
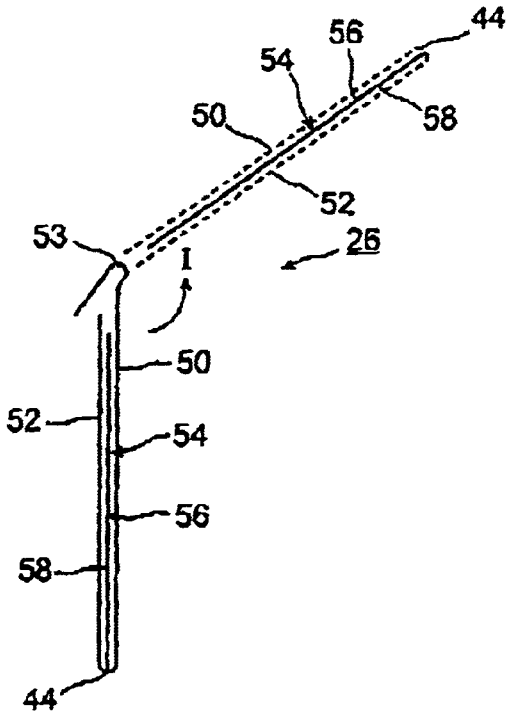
FIG. 15 is a side view of the display pocket of the information display system in keeping with the present invention where the display pocket is rotated upward at least 90 degrees from its static position.

As particularly suggested by FIG. 15, the at least one display pocket 26 is capable of being manipulated by swinging it upward as indicated by arrow I. Thus, product information contained on the back face 58 of the at least one display card 54 can be viewed by the prospective customers. Since each of the at least one display pocket 26 is swung upwardly such as indicated by arrow I, it is appreciated that information contained on the back face 58 of the at least one display card 54 lies head to toe to information provided on the front face 56 of the at least one display card 54 so as to permit the customers to read the information contained on the at least one display card 54 easily. Also, it is noted that when the at least one display pocket 26 is released, it will simply fall to the original position.

Indeed, with reference to FIGS. 8 through 12, when the first display pocket 26*a* is hingedly rotated upward at least 90 degrees from the plane of the front presentation face 20, the back panel 52 of the first display pocket 26*a* is visible.

Each of the information display systems 500, 600 and 700 shown in FIGS. 8 through 12 further comprises at least a first display pocket 26*a* and at least a second display pocket 26*b*. The first and second side ends 46*a* and 46*b* respectively of the at least two display pockets 26 lie adjacent to the respective stiffening ribs 22.

When each of the information display systems 500, 600 and 700 is in a static position, the at least two display pockets 26 are arranged in a stepped manner such that the first display pocket 26*a* overlies a substantial portion of the second display pocket 26*b*. In this manner, a much greater number of display pockets 26 are presented in a small area. When the first display pocket 26*a* is hingedly rotated upward at least 90 degrees from the plane of the front presentation face 20, the back panel 52 of the first display pocket 26*a* and the top panel 50 of the second display pocket 26*b* are visible.

Figure 16:
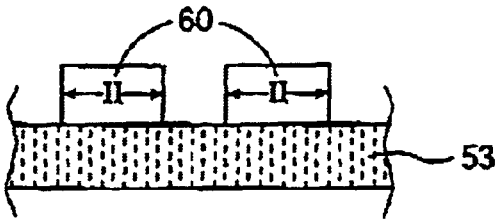
FIG. 16 is an elevated view of a first embodiment of a hinge portion of the top panel of the display pocket in keeping with the present invention where the hinge portion of the display pocket has tangs projected therefrom.
Figure 19:
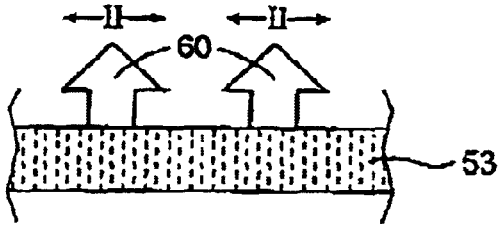
FIG. 19 is an elevated view of a second embodiment of a hinge portion of the top panel of the display pocket in keeping with the present invention where the hinge portion of the display pocket has tangs projected therefrom.

Typically, but not necessarily, the hinge portion 53 of the top panel 50 of the at least one display pocket 26 may comprise at least one tang 60 projecting therefrom (best seen in FIGS. 16 and 19). The at least one tang 60 may be in the shape of a rectangle (FIG. 16) or an arrow (FIG. 19). In order for the at least one display pocket 26 to be hingedly attached to the front presentation face 20 of the information display system, the front presentation face 20 has at least one opening 62, as particularly suggested in FIGS. 17 and 20, through which the at least one tang 60 projecting from the hinge portion 53 of the top panel 50 of the at least one display pocket 26 may be inserted (FIGS. 18 and 21).

Figure 17:
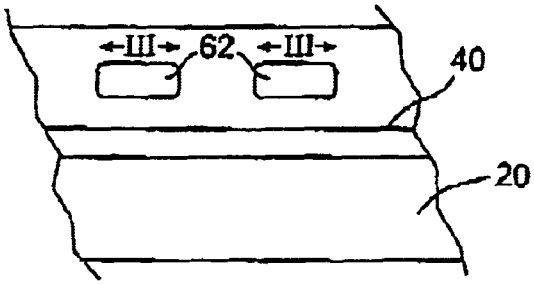
FIG. 17 is a perspective view of a first embodiment of a portion of the front presentation face of the information display system in keeping with the present invention where the front presentation face has openings through which tangs projecting from the hinge portion of the display pocket may be inserted.
Figure 20:
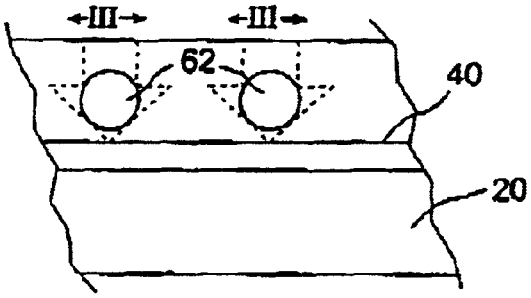
FIG. 20 is a perspective view of a second embodiment of a portion of the front presentation face of the information display system in keeping with the present invention where the front presentation face has openings through which tangs projecting from the hinge portion of the display pocket may be inserted.
Figure 18:
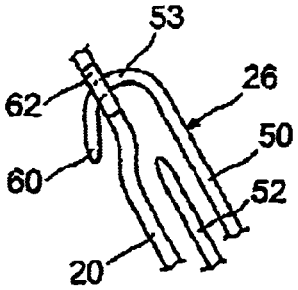
FIG. 18 is an exploded side view of a first embodiment of the hinge portion of the display pocket in keeping with the present invention, when hingedly attached to the front presentation face of the information display system.
Figure 21:
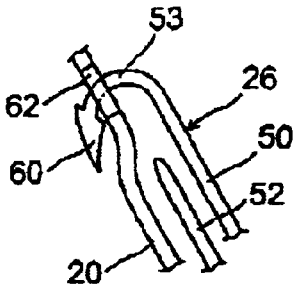
FIG. 21 is an exploded side view of a second embodiment of the hinge portion of the display pocket in keeping with the present invention, when hingedly attached to the front presentation face of the information display system.

The at least one tang 60 is slightly longer in length, designated by reference character II in FIGS. 16 and 19, than the diameter of the at least one opening 62 which is represented by reference character III in FIGS. 17 and 20. Thus, the at least one tang 60 of the at least one display pocket 26 is inserted into the at least one opening 62 of the front presentation face 20 either by forcing the at least one tang 60 through the at least one opening 62 or by sliding the at least one tang 60 widthwise into the at least one opening 62.

Figure 22:
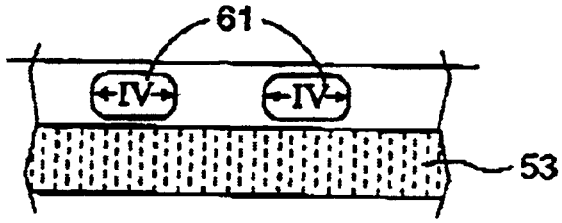
FIG. 22 is an elevated view of a third embodiment of a hinge portion of the top panel of the display pocket in keeping with the present invention where the hinge portion of the display pocket has buttons formed thereon.

Alternatively, but not necessarily, the hinge portion 53 of the top panel 50 of the at least one display pocket 26 may comprise at least one button 61 which is formed thereon (FIG. 22). In such a particular embodiment, the front presentation face 20 has at least one opening through which the at least one button 61 which is formed on the hinge portion 53 of the top panel 50 of the at least one display pocket 26 may be inserted so as to permit the at least one display pocket 26 to be hingedly attached to the front presentation face 20, as shown in FIGS. 23 and 24.

Figure 23:
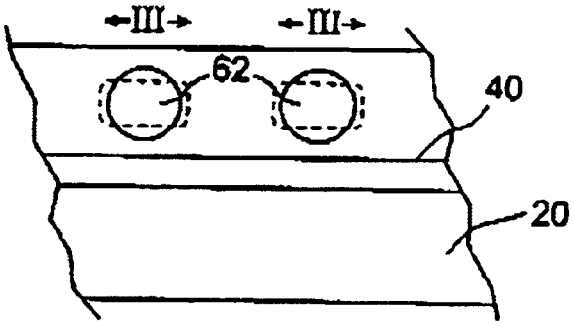
FIG. 23 is a perspective view of a third embodiment of a portion of the front presentation face of the information display system in keeping with the present invention where the front presentation face has openings through which buttons formed on the hinge portion of the display pocket may be inserted.
Figure 24:
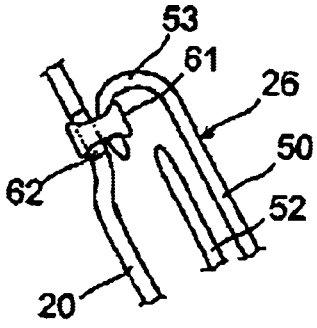
FIG. 24 is an exploded side view of a third embodiment of the hinge portion of the display pocket in keeping with the present invention, when hingedly attached to the front presentation face of the information display system.

Furthermore, the at least one button 61 is slightly greater in at least one dimension, designated by reference character IV in FIG. 22, than the diameter of the at least one opening 62 which is represented by reference character III in FIG. 23. Thus, the at least one button 61 of the at least one display pocket 26 is forced through the at least one opening 62 of the front presentation face 20.

Figure 25:
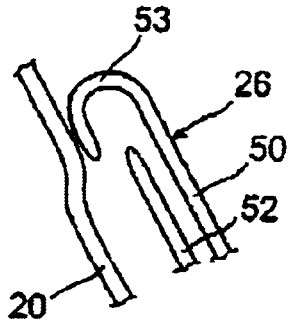
FIG. 25 is an exploded side view of a fourth embodiment of the hinge portion of the display pocket in keeping with the present invention, when hingedly attached to the front presentation face of the information display system.

Generally, the at least one display pocket 26 is hingedly attached to the front presentation face 20 by fastening means chosen from the group of fastening means consisting of:

(a) inserting the at least one tang 60 which projects from the hinge portion 53 of the top panel 50 of the at least one display pocket 26 through the at least one opening 62 situated in the front presentation face 20, as particularly suggested by FIGS. 18 and 21;

(b) inserting the at least one button 61 which is formed on the hinge portion 53 of the top panel 50 of the at least one display pocket 26 through the at least one opening 62 situated in the front presentation face 20, as particularly suggested by FIG. 24;

(c) gluing the hinge portion 53 of the top panel 50 of the at least one display pocket 26 to the front presentation face 20, as particularly suggested by FIG. 25; and (d) welding the hinge portion 53 of the top panel 50 of the at least one display pocket 26 to the front presentation face 20, as particularly suggested by FIG. 25.

When the at least one display pocket 26 is hingedly attached to the front presentation face 20 by insertion of the at least one tang 60 which projects from the hinge portion 53 of the top panel 50 of the at least one display pocket 26 through the at least one opening 62 of the front presentation face 20, the at least one display pocket 26 may be removed from the information display system if necessary. The at least one tang 60 of the at least one display pocket 26 which is to be removed from the information display system may be snapped out of the at least one respective opening 62 either with a sharp pull or by sliding the at least one tang 60 widthwise out of the at least one opening 62 of the front presentation face 20.

In another embodiment where the at least one display pocket 26 is hingedly attached to the front presentation face 20 by insertion of the at least one button 61 which is formed on the hinge portion 53 of the top panel 50 of the at least one display pocket 26 through the at least one opening 62 of the front presentation face 20, the at least one display pocket 26 may also be removed from the information display system if necessary. The at least one button 61 of the at least one display pocket 26 which is to be removed from the information display system may be snapped out of the at least one respective opening 62 of the front presentation face 20 with a sharp pull.

Typically, the shelf contacting panel 18 of the information display systems described herein is adapted to be affixed to the substantially planar top support surface 12 of a shelf 14 by attachment means, which are represented by reference numeral 64. The attachment means 64 may be bolts. Other attachment means 64 which may be used are rivets, studs, pins and staples.

Figure 26:
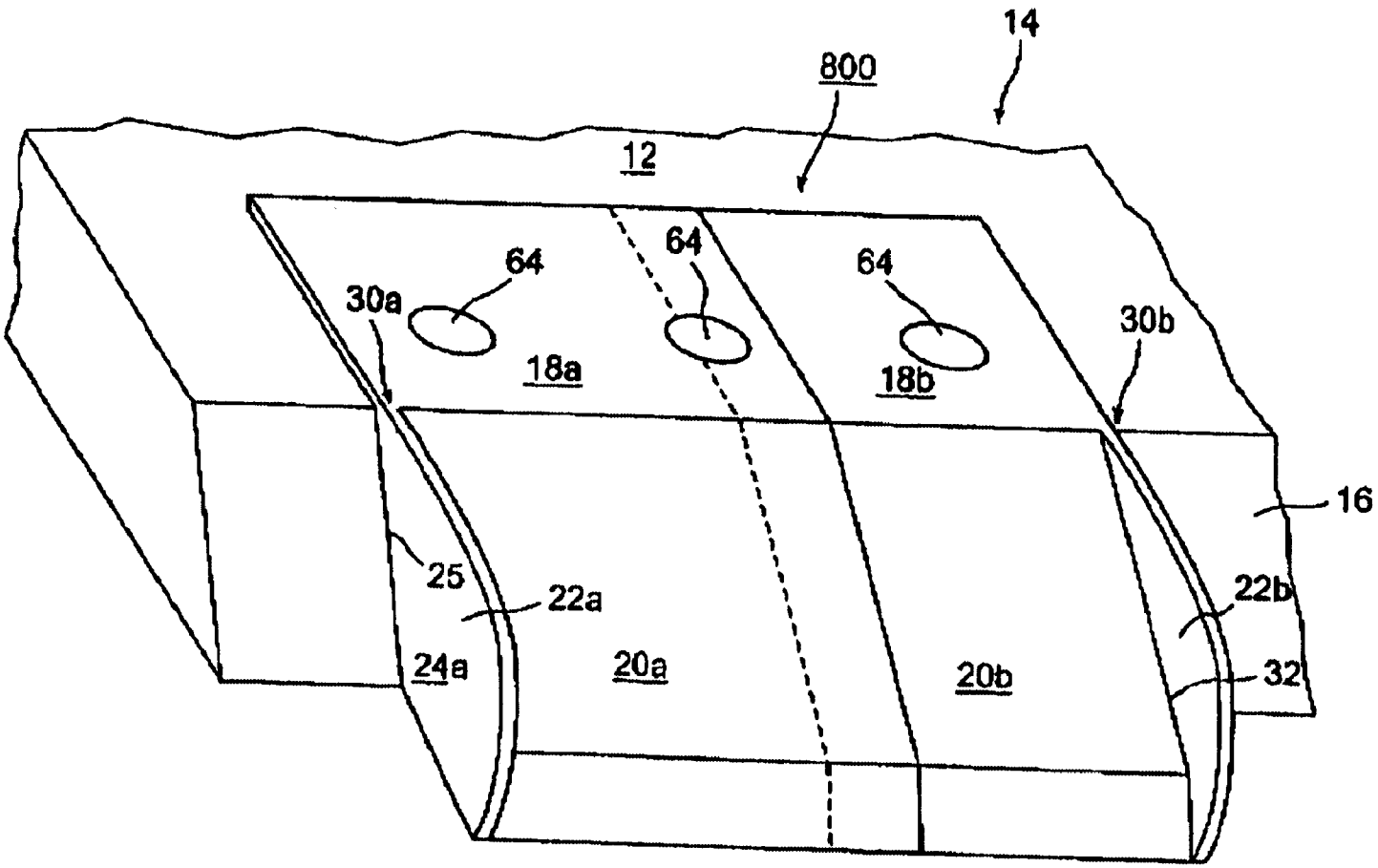
FIG. 26 is a perspective view of an eighth embodiment of the information display system in keeping with the present invention, when affixed to the substantially planar top support surface of a shelf having a downwardly depending front edge in the front edge region thereof.

In keeping with the provisions of the present invention, the inventors herein provide an information display system 800 in which the shelf contacting panel 18 and the front presentation face 20 of the base portion 17 are in halves (FIG. 26). A portion of one half of the shelf contacting panel 18*a* overlies a portion of the other half of the shelf contacting panel 18*b*. Furthermore, a portion of one half of the front presentation face 20*a* overlies a portion of the other half of the front presentation face 20*b*. The two halves of the shelf contacting panel 18*a* and 18*b* are joined one over the other so as to form an integral structure by attachment means 64.

Figure 27:
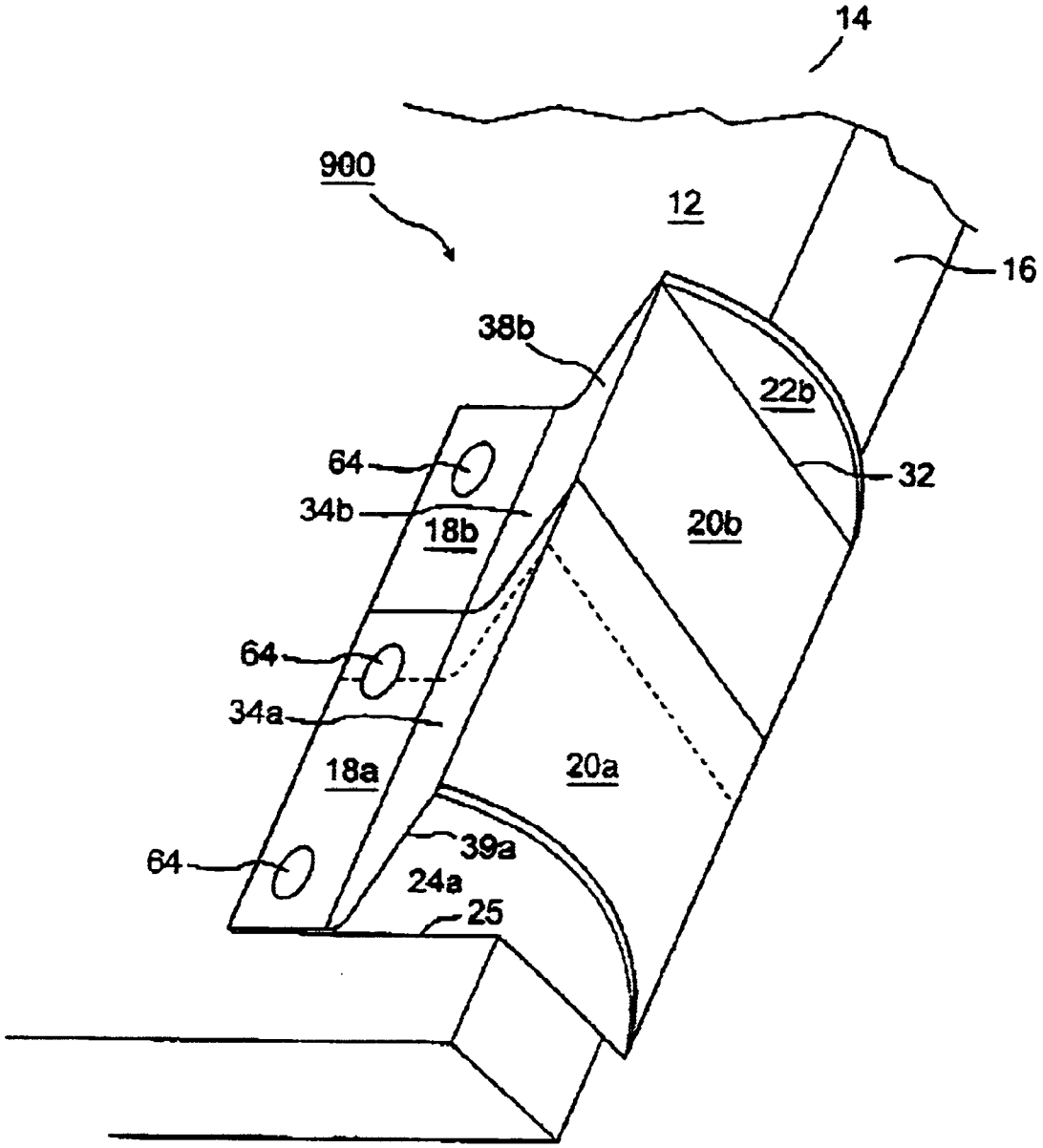
FIG. 27 is a perspective view of a ninth embodiment of the information display system in keeping with the present invention, when affixed to the substantially planar top support surface of a shelf having a downwardly depending front edge in the front edge region thereof.

In yet another embodiment of the present invention shown in FIG. 27, the shelf contacting panel 18, the supporting panel 34, the front presentation face 20 of the base portion 17 of the information display system 900 are in halves. A portion of one half of the shelf contacting panel 18*a* overlies a portion of the other half of the shelf contacting panel 18*b*. Furthermore, a portion of one half of the supporting panel 34*a* overlies a portion of the other half of the supporting panel 34*b*. Still further, a portion of one half of the front presentation face 20*a* overlies a portion of the other half of the front presentation face 20*b*. The two halves of the shelf contacting panel 18*a* and 18*b* are then joined one over the other so as to form an integral structure by attachment means 64.

An advantage to the information display systems 800 and 900 shown herein is that different sizes of the at least one display pocket 26 may be accommodated provided that the first and second side ends 46*a* and 46*b* respectively of each of the at least one display pocket 26 lie adjacent to the respective stiffening ribs 22 of the system. Thus, depending on the amount of space available in the front edge 16 of the shelf 14, the retail store personnel may adjust the information display systems 800 and 900 in such a manner that the two halves of each of the information display systems 800 and 900 support the at least one display pocket 26 of the appropriate size.

Figure 28:
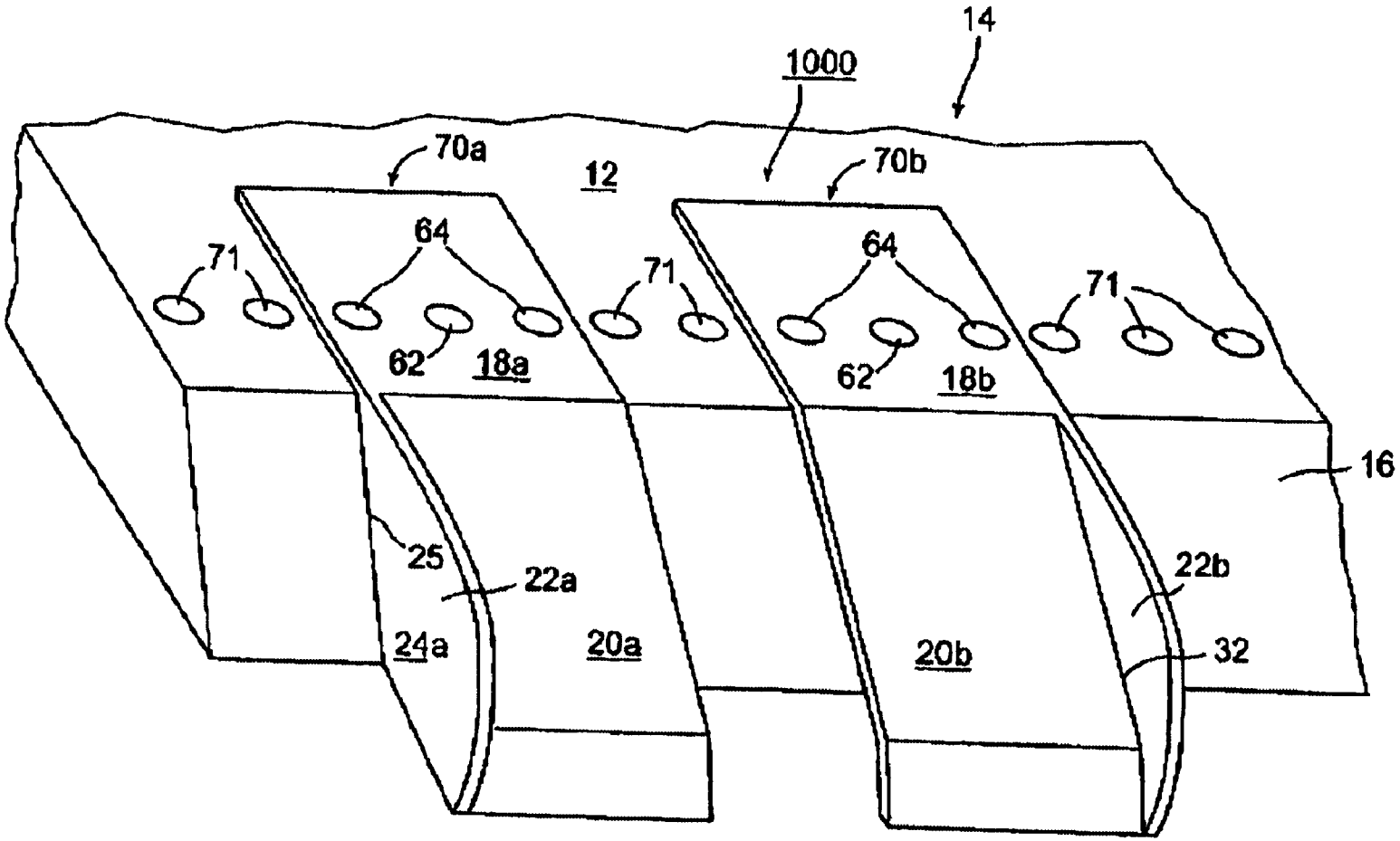
FIG. 28 is a perspective view of a tenth embodiment of the information display system in keeping with the present invention, when affixed to the substantially planar top support surface of a shelf having a downwardly depending front edge in the front edge region thereof.

Finally, referring to FIG. 28, another embodiment of the information display system of the present invention is shown which differs from that shown in FIGS. 26 and 27 in that the two halves of the base portion are not in contact one with the other. Rather, the two halves 70*a* and 70*b* of the information display system 1000 are mirror images one of the other, with the respective stiffening ribs 22*a* and 22*b* being at the respective left and right edges of the respective front presentation faces 20*a* and 20*b*, respectively.

Each of the half base portions 70*a* and 70*b* is affixed to the substantially planar support surface 12 of the shelf 14 by suitable attachment means 64, as described above. Typically, additional opening may also be formed through the respective half shelf contacting panels 18*a* and 18*b*, as shown at 62. The substantially planar top surface 12 of the shelf 14 is typically formed with a plurality of openings 71; and the spacing between the openings 62 formed in the half shelf contacting panels 18*a* and 18*b*, and the holes 71 formed in the shelf 14, are standardized. This enables the half base portions 70*a* and 70*b* to be positioned so as to accommodate a display pocket 26 (not shown in FIG. 28) in the manner described above, where the first and second side ends 46*a* and 46*b* of an at least one display pocket 26 are accommodated between the respective stiffening ribs 22*a* and 22*b*.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. An information display system which is adapted to be affixed to a substantially planar top support surface of a shelf having a front edge region and a downwardly depending front therein, said information display system comprising:

a base portion which includes a planar shelf contacting panel, a front presentation face, a pair of stiffening ribs, and two side panels, and with at least one display pocket;

wherein said base portion is an integral structure;

wherein said front presentation face is in a plane which intersects the plane of said shelf contacting panel, and wherein said at least one display pocket is hingedly attached to said front presentation face;

wherein said front presentation face has first and second ends wherein each of said first and second ends has one said stiffening rib and one said side panel which are contiguous one with the other, and wherein said stiffening rib and said respective side panel occupy the same plane which is perpendicular to the plane of said front presentation face and the plane of said shelf contacting panel;

wherein each of said stiffening ribs extends outwardly beyond said front presentation face and wherein each of said stiffening ribs has an edge which coincides with the respective first and second ends of said front presentation face in the edge regions thereof;

wherein each of said side panels has one side edge which contacts one of the substantially planar top support surface of the shelf in the front edge region thereof, or the surface of the front shelf edge, when said information display system is in use;

wherein said at least one display pocket has top and bottom edges and first and second side ends, and wherein said at least one display pocket has top and bottom panels wherein said top panel overlies a substantial portion of said bottom panel;

wherein said bottom edge of said top panel and said bottom edge of said bottom panel are sealed one to the other;

wherein said at least one display pocket is openable in at least one of the top and first and second side ends such that at least one display card may be inserted between said top and bottom panels of said at least one display pocket;

wherein said top panel of said at least one display pocket has at least a portion in the region of said top edge which forms a hinge so as to hingedly attach said at least one display pocket to said front presentation face; and wherein said first and second side ends of said at least one display pocket lie adjacent to said respective stiffening ribs, when said at least one display pocket is hingedly attached to said front presentation face.

2. The information display system of claim 1, wherein said information display system is formed from plastics material.

3. The information display system of claim 2, wherein said plastics material of said at least one display pocket is translucent such that each of the faces of said at least one display card which is contiguous with said top and bottom panels of said at least one display pocket is visible through said top and bottom panels of said at least one display pocket.

4. The information display system of claim 1, wherein a portion of said front presentation face comprises a plurality of steps, wherein at least one of said steps is adapted to have said at least one display pocket, and wherein said at least one display pocket is hingedly attached.

5. The information display system of claim 1, wherein said hinge portion of said top panel of said at least one display pocket has at least one tang projecting therefrom.

6. The information display system of claim 5, wherein said front presentation face has at least one opening through which said at least one tang projecting from said hinge portion of said top panel of said at least one display pocket may be inserted.

7. The information display system of claim 1, wherein said hinge portion of said top panel of said at least one display pocket has at least one button formed thereon.

8. The information display system of claim 7, wherein said front presentation face has at least one opening through which said at least one button formed on said hinge portion of said top panel of said at least one display pocket may be inserted.

9. The information display system of claim 1, wherein said at least one display pocket is hingedly attached to said front presentation face by fastening means chosen from the group of fastening means consisting of:

(a) inserting at least one tang which projects from said hinge portion of said top panel of said at least one display pocket through at least one opening situated in said front presentation face;

(b) inserting at least one button which is formed on said hinge portion of said top panel of said at least one display pocket through at least one opening situated in said front presentation face;

(c) gluing said hinge portion of said top panel of said at least one display pocket to said front presentation face; and (d) welding said hinge portion of said top panel of said at least one display pocket to said front presentation face.

10. The information display system of claim 1, wherein when said at least one display pocket is hingedly rotated upward at least 90 degrees from the plane of said front presentation face, said bottom panel of said at least one display pocket is visible.

11. The information display system of claim 1, wherein said information display system comprises at least a first display pocket and at least a second display pocket.

12. The information display system of claim 11, wherein said at least first and second display pockets are arranged in a stepped manner such that said first display pocket overlies a substantial portion of said second display pocket when said information display system is in a static position.

13. The information display system of claim 11, wherein when said first display pocket is hingedly rotated upward at least 90 degrees from the plane of said front presentation face, said bottom panel of said first display pocket and said top panel of said second display pocket are visible.

14. The information display system of claim 1, wherein said base portion further comprises a supporting panel which extends upwardly from said shelf contacting panel, and wherein said supporting panel and said shelf contacting panel are contiguous one with the other.

15. The information display system of claim 14, wherein said supporting panel is in a plane which intersects the plane of said shelf contacting panel, and wherein the plane of said supporting panel intersects the plane of said front presentation face and each of the planes occupied by each of said stiffening ribs and the respective side panels.

16. The information display system of claim 14, wherein said supporting panel has first and second side edges wherein each of said first and second side edges coincides with one of the side edges of each of said side panels.

17. The information display system of claim 1, wherein said shelf contacting panel is adapted to be affixed to the substantially planar top support surface of a shelf having a downwardly depending front edge in the front edge region thereof by attachment means chosen from the group of attachment means consisting of bolts, rivets, studs, pins, and staples.

18. The information display system of claim 17, wherein when said shelf contacting panel and said front presentation face of said base portion are in two halves, a portion of one half of said shelf contacting panel overlies a portion of the other half of said shelf contacting panel, and a portion of one half of said front presentation face overlies a portion of the other half of said front presentation face, and wherein said two halves of said shelf contacting panel are joined one over the other so as to form an integral structure.

19. The information display system of claim 17, wherein when said shelf contacting panel, said supporting panel and said front presentation face of said base portion are in two halves, a portion of one half of said shelf contacting panel overlies a portion of the other half of said shelf contacting panel, a portion of one half of said supporting panel overlies a portion of the other half of said supporting panel, and a portion of one half of said front presentation face overlies a portion of the other half of said front presentation face, and wherein said two halves of said shelf contacting panel are joined one over the other so as to form an integral structure.

20. An information display system which is adapted to be affixed to a substantially planar top support surface of a shelf having a front end region and a downwardly depending front edge therein said information display system comprising:

a base portion which includes a planar shelf contacting panel, a front presentation face, a pair of stiffening ribs, and two side panels, and with at least one display pocket;

wherein said base portion comprises two halves, each of which is a mirror image of the other half;

wherein the self contacting panel of each half of said base portion is adapted to be affixed to the substantially planar top support surface of a shelf having a downwardly depending front edge in the front region thereof, in a manner so as to be spaced apart by a first predetermined distance whereby said pair of stiffening ribs are spaced apart by a second predetermined distance;

wherein said front presentation face of each half of said base portion is in a plane which intersects the plane of said shelf contacting panel, and wherein said at least one display pocket is hingedly attached to said front presentation face;

wherein said front presentation face has first and second ends wherein each of said first and second ends has one said stiffening rib and one said side panel which are contiguous one with the other, and wherein said stiffening rib and said respective side panel occupy the same plane which is perpendicular to the plane of said front presentation face and the plane of said shelf contacting panel;

wherein each of said stiffening ribs extends outwardly beyond said front presentation face of each half of said base portion, and wherein each of said stiffening ribs has an edge which coincides with the respective first and second ends of said respective half of said front presentation face in the edge regions thereof;

wherein each of said side panels has one side edge which contacts one of the substantially planar top support surface of the shelf in the front edge region thereof, or the surface of the front shelf edge, when said information display system is in use;

wherein said at least one display pocket has top and bottom edges and first and second side ends, and wherein said at least one display pocket has top and bottom panels wherein said top panel overlies a substantial portion of said bottom panel;

wherein said bottom edge of said top panel and said bottom edge of said bottom panel are sealed one to the other;

wherein said at least one display pocket is openable in at least one of the top and first and second side ends such that at least one display card may be inserted between said top and bottom panels of said at least one display pocket;

wherein said top panel of said at least one display pocket has at least a portion in the region of said top edge which forms a hinge so as to hingedly attach said at least one display pocket to said front presentation face; and wherein said first and second side ends of said at least one display pocket lie adjacent to said respective stiffening ribs, when said at least one display pocket is hingedly attached to said front presentation face.

21. The information display system of claim 20, wherein said information display system is formed from plastics material, and the plastics material of said at least one display pocket is translucent such that each of the faces of said at least one display card which is contiguous with said top and bottom panels of said at least one display pocket is visible through said top and bottom panels of said at least one display pocket.

22. The information display system of claim 20, wherein each half of said base portion further comprises a supporting panel which extends upwardly from said shelf contacting panel, and wherein said supporting panel and said shelf contacting panel of each half of said base portion are contiguous one with the other.

23. The information display system of claim 22, wherein each respective supporting panel is in a plane which intersects the plane of the respective shelf contacting panel, and wherein the plane of each said supporting panel intersects the plane of said front presentation face and each of the planes occupied by each of said stiffening ribs and the respective side panels.

24. The information display system of claim 20, wherein each respective shelf contacting panel is adapted to be affixed to the substantially planar top support surface of a shelf having a downwardly depending front edge in the front edge region thereof by attachment means chosen from the group of attachment means consisting of bolts, rivets, studs, pins, and staples.

* * * * *